US006032939A

United States Patent [19]

Chen

[11] Patent Number: 6,032,939

[45] Date of Patent: Mar. 7, 2000

[54] CLAMP DEVICE

[76] Inventor: Jenn-Tzong Chen, 58, Ma Yuan West St., Taichung, Taiwan

[21] Appl. No.: 09/357,112

[22] Filed: Jul. 19, 1999

[51] Int. Cl.[7] ..... B25B 1/10

[52] U.S. Cl. ..... 269/249; 269/251

[58] Field of Search ..... 269/249, 251; 24/514, 569, 522, 525; 403/344, 290, 373

[56] References Cited

U.S. PATENT DOCUMENTS 5,131,780 7/1992 Love ..... 269/249

*Primary Examiner*—Robert C. Watson

[57] ABSTRACT

A clamp device has a generally U-shaped body member, and a generally L-shaped body member. The L-shaped body member has a longitudinal portion, a transverse portion, and an anti-skid pod. A through hole and a guide groove are formed on the L-shaped body member. The U-shaped body member has a first leg, a second leg, and an anti-slip pod. An insertion block is disposed on the second leg. The insertion block is inserted in the guide groove. The second leg has a hexagonal hole and a round opening communicating with the hexagonal hole. A nut is inserted in the hexagonal hole. A bolt fastens the U-shaped body member and the L-shaped body member together.

2 Claims, 6 Drawing Sheets

CLAMP DEVICE

BACKGROUND THE INVENTION

The present invention relates to a clamp device. More particularly, the present invention relates to a clamp device which has a generally L-shaped body member having a guide groove and a generally U-shaped body member having an insertion block inserted in the guide groove of the generally L-shaped body member.

U.S. Pat. No. 5,131,780 has disclosed a C-clamp. The C-clamp has a generally U-shaped body part, a generally L-shaped body part, and a bolt fastening the generally U-shaped body part and the generally L-shaped body part together. The generally U-shaped body part includes a first integral grooved clamping pod formed on a first leg of the generally U-shaped body part. A first bore extends through an opposite second leg of the generally U-shaped body part. The second leg of the generally U-shaped body part is thicker in cross section than the first leg of the generally U-shaped body part to accomodate the first bore with sufficient wall thickness to provide the required strength for the C-clamp. The generally L-shaped body part includes an arm and a third leg. A second bore extends through the arm adjacent to the third leg. A second integral grooved clamping pod is located at the free end of the arm. The third leg of the generally L-shaped body part includes a flat inner surface. The generally U-shaped body part and the generally L-shaped body part are interconnected by the bolt having its shank extending through the second bore of the generally L-shaped body part and accomidated within the threaded portion of the first bore. A washer is carried by the bolt and positioned between the head of the bolt and the generally L-shaped body part. The generally U-shaped body part and the generally L-shaped body part are positioned such that the smooth outer surface of the generally U-shaped body part slidably contacts the smooth inner surface of the generally L-shaped body part. However, the generally L-shaped body part will be rotated after a long period of usage.

SUMMARY OF THE INVENTION

An object of the present invention is to provide a clamp device which can fasten two articles stably.

Another object of the present invention is to provide a clamp device which has a generally L-shaped body member having a guide groove and a generally U-shaped body member having an insertion block inserted in the guide groove of the generally L-shaped body member so that the generally L-shaped body member will not be rotated while the generally L-shaped body member and the generally U-shaped body member fasten two articles together.

Accordingly, a clamp device comprises a generally U-shaped body member, a generally L-shaped body member, a washer, and a bolt. The generally L-shaped body member has a longitudinal portion, a transverse portion, and an anti-skid pod located at a free end of the generally L shaped body member. A through hole is formed on the transverse portion of the generally L-shaped body member. A guide groove is formed on the longitudinal portion of the generally L-shaped body member. The generally U-shaped body member has a first leg, a second leg, and an anti-slip pod located at a free end of the generally U-shaped body member. An insertion block is disposed on the second leg. The insertion block is in serted in the guide groove of the generally L-shaped body member. A hexagonal hole is formed in the second leg. A round opening is formed on an upper end of the second leg communicating with the hexagonal hole. The through hole of the generally L-shaped body member matches the hexagonal hole and the round opening of the second leg. A nut is inserted in the hexagonal hole of the second leg. A washer is disposed on the transverse portion of the generally L-shaped body member matching the through hole of the generally L-shaped body member. The bolt has a hexagonal head and a threaded shank. The bolt passes through the washer, the through hole of the generally L-shaped body member, the round opening of the second leg, and the nut. The bolt is inserted in the hexagonal hole of the second leg.

DETAILED DESCRIPTION OF THE INVENTION

Figure 1:
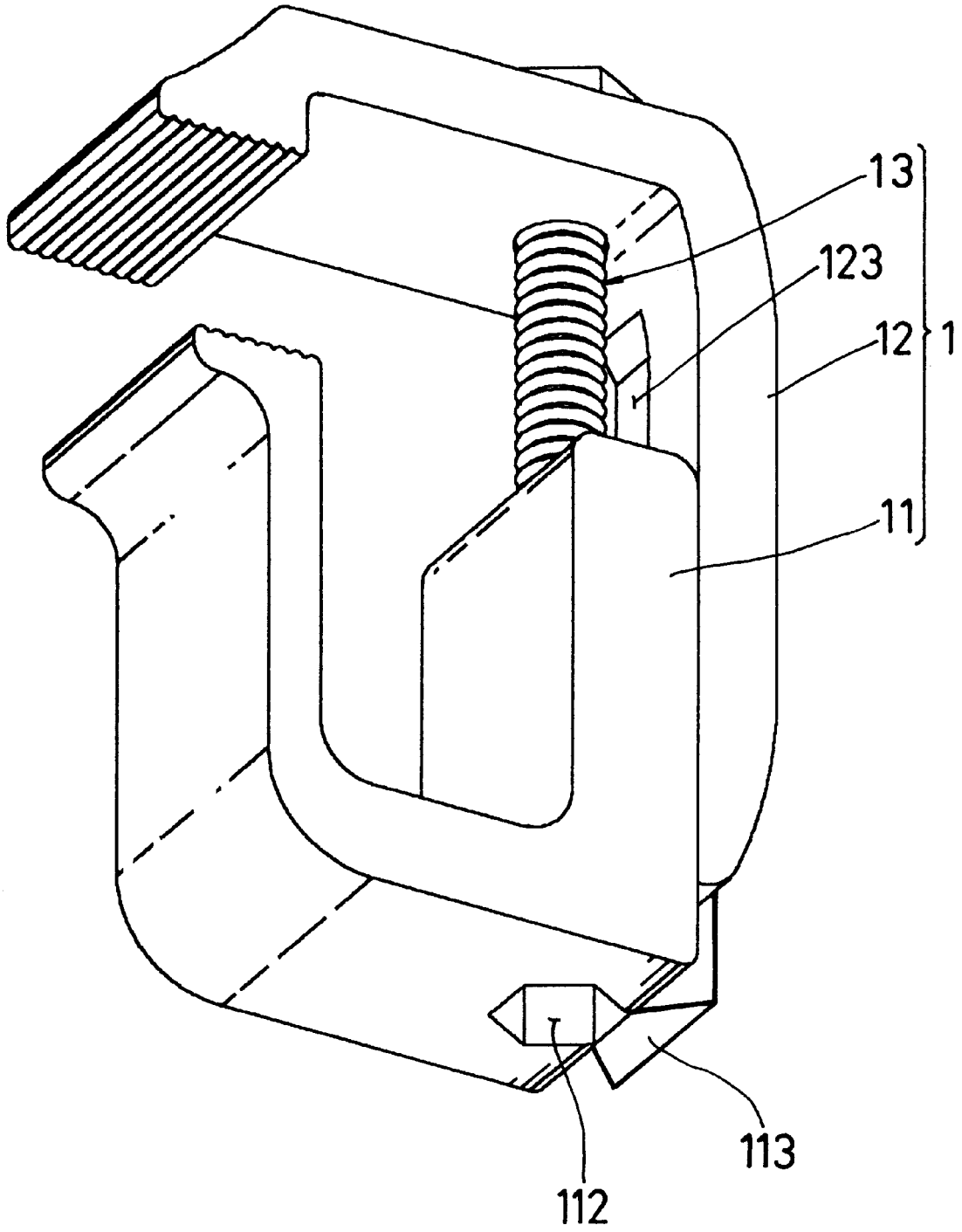
FIG. 1 is a perspective assembly view of a clamp device of a preferred embodiment in accordance with the present invention.
Figure 2:
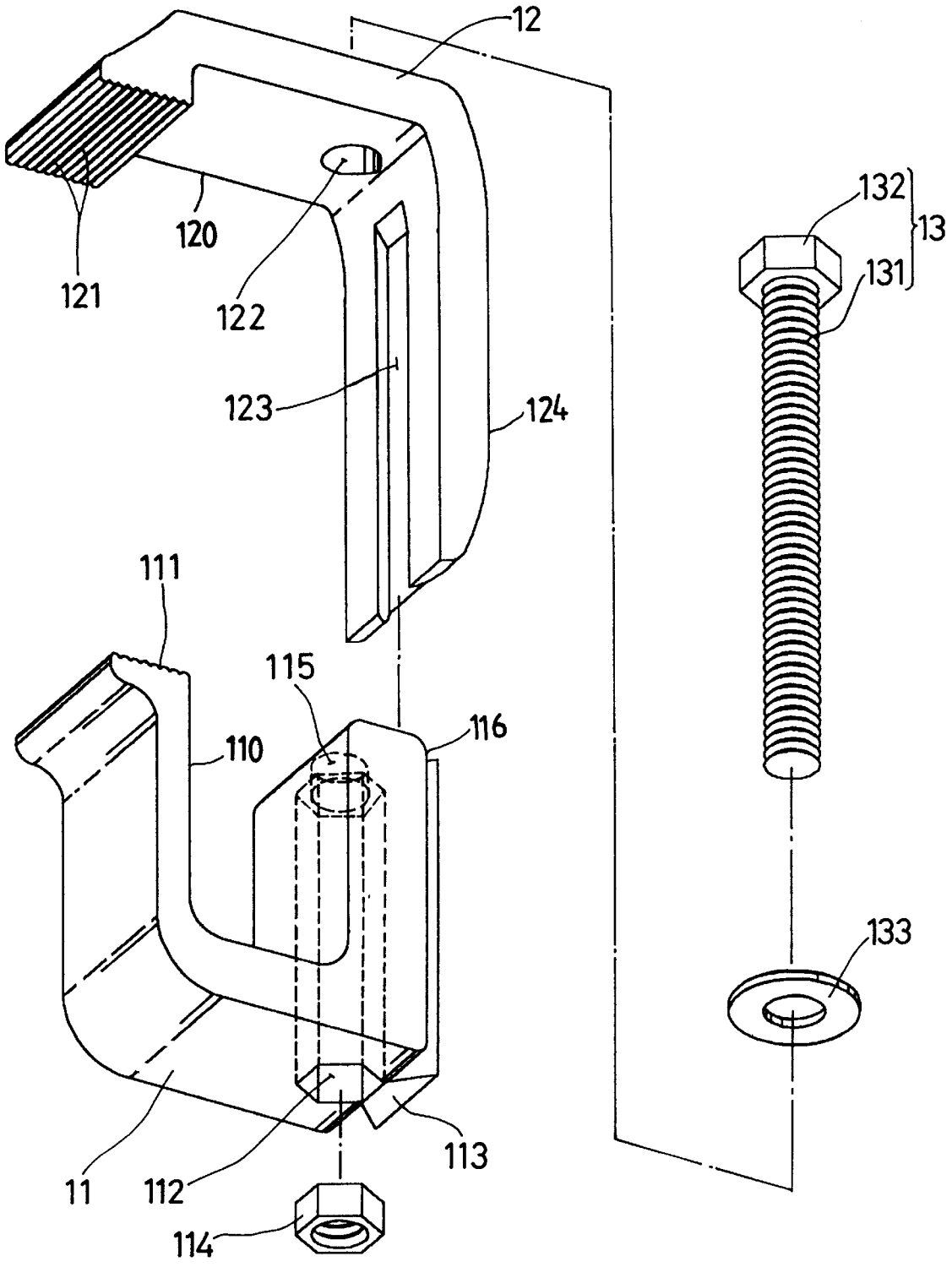
FIG. 2 is a perspective exploded view of a clamp device of a preferred embodiment in accordance with the present invention.
Figure 3:
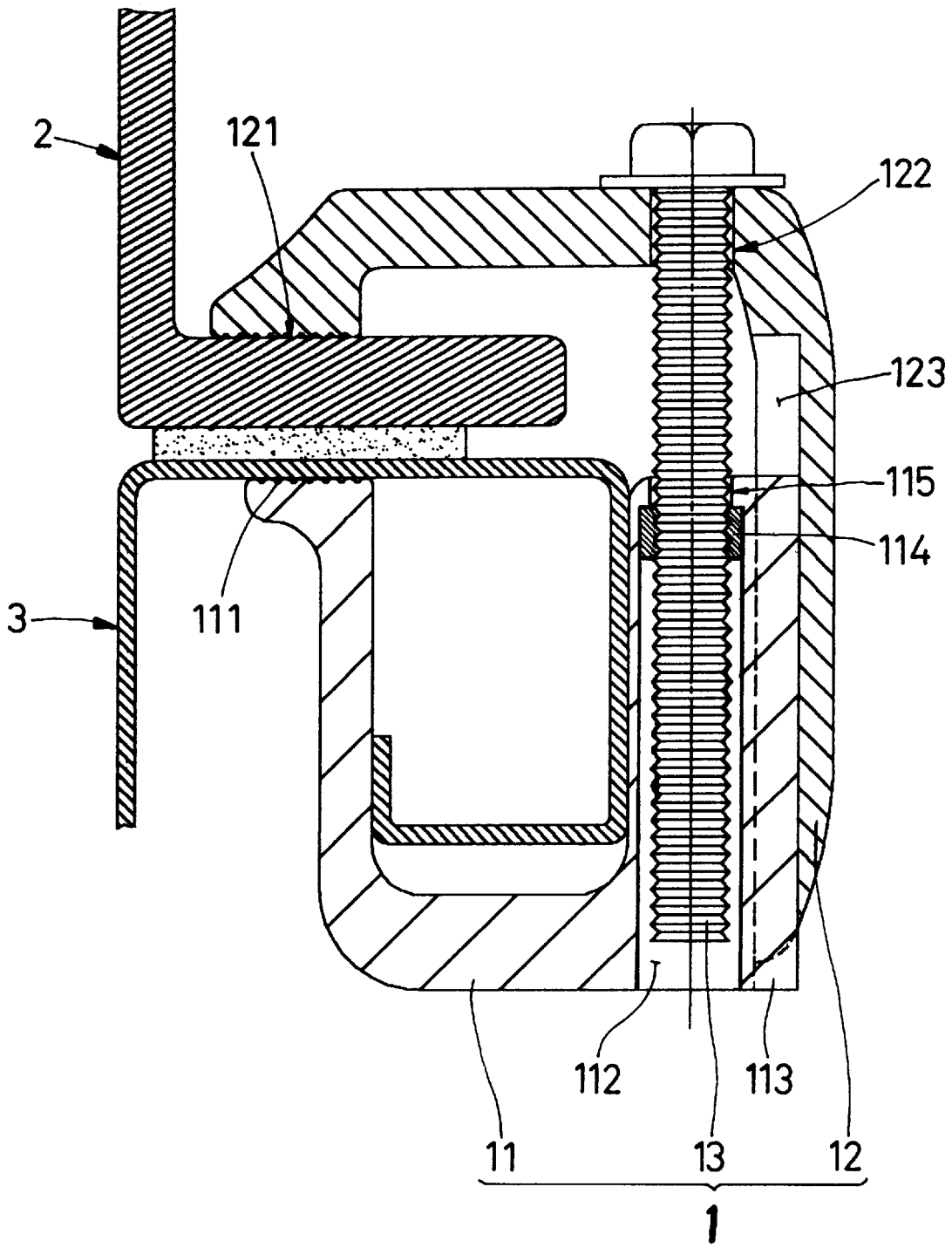
FIG. 3 is a schematic view illustrating a clamp device of a preferred embodiment clamping a cap and a truck bed rail together.

Referring to FIGS. 1 to 6, a clamp device 1 comprises a generally U-shaped body member 11, a generally L-shaped body member 12, a washer 133, and a bolt 13.

The generally L-shaped body member 12 has a longitudinal portion 124, a transverse portion 120, and an anti-skid pod 121 located at a free end of the generally L-shaped body member 12.

A through hole 122 is formed on the transverse portion 120 of the generally L-shaped body member 12.

A guide groove 123 is formed on the longitudinal portion 124 of the generally L-shaped body member 12.

The generally U-shaped body member 11 has a first leg 110, a second leg 116, and an anti-slip pod 111 located at a free end of the generally U-shaped body member 11.

A dovetail-shaped insertion block 113 is disposed on the second leg 116. The dovetail-shaped insertion block 113 is inserted in the guide groove 123 of the generally L-shaped body member 12.

A hexagonal hole 112 is formed in the second leg 116. A round opening 115 is formed on an upper end of the second leg 116 communicating with the hexagonal hole 112. The through hole 122 of the generally L-shaped body member 12 matches the hexagonal hole 112 and the round opening 115 of the second leg 116.

A nut 114 is inserted in the hexagonal hole 112 of the second leg 116.

The washer 133 is disposed on the transverse portion 120 of the generally L-shaped body member 12 matching the through hole 122 of the generally L-shaped body member 12.

The bolt 13 has a hexagonal head 132 and a threaded shank 131.

The bolt 13 passes through the washer 133, the through hole 122 of the generally L-shaped body member 12, the round opening 115 of the second leg 116, and the nut 114.

The bolt 13 is inserted in the hexagonal hole 112 of the second leg 116.

Referring to FIG. 3 again, the anti-skid pod 121 of the generally L-shaped body member 12 presses a cap 2 or a first article downward. The anti-slip pod 111 of the generally U-shaped body member 11 presses a truck bed rail 3 or a second article upward.

Figure 4:
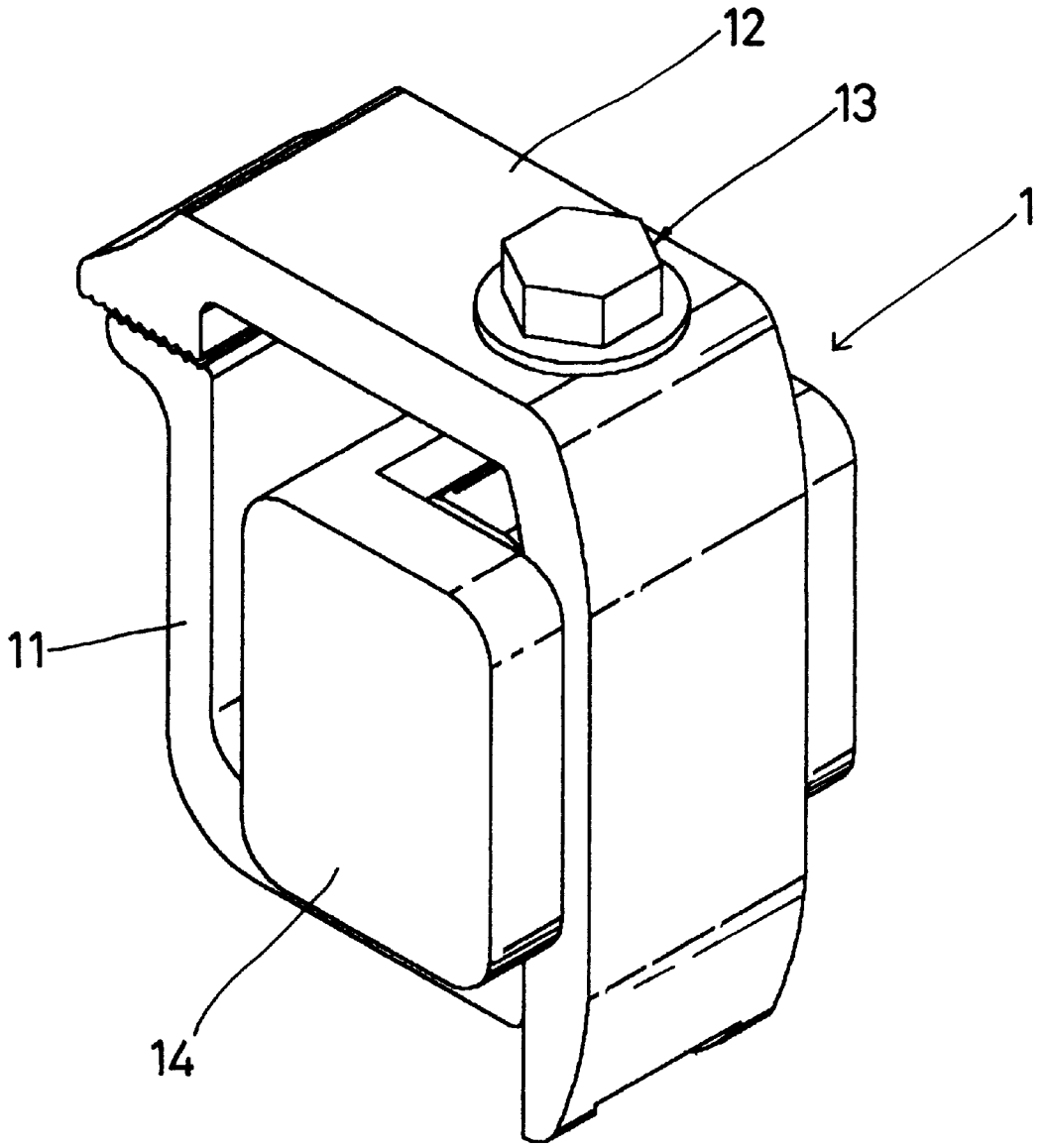
FIG. 4 is a perspective assembly view of a clamp device and a lining block of a preferred embodiment in accordance with the present invention.
Figure 5:
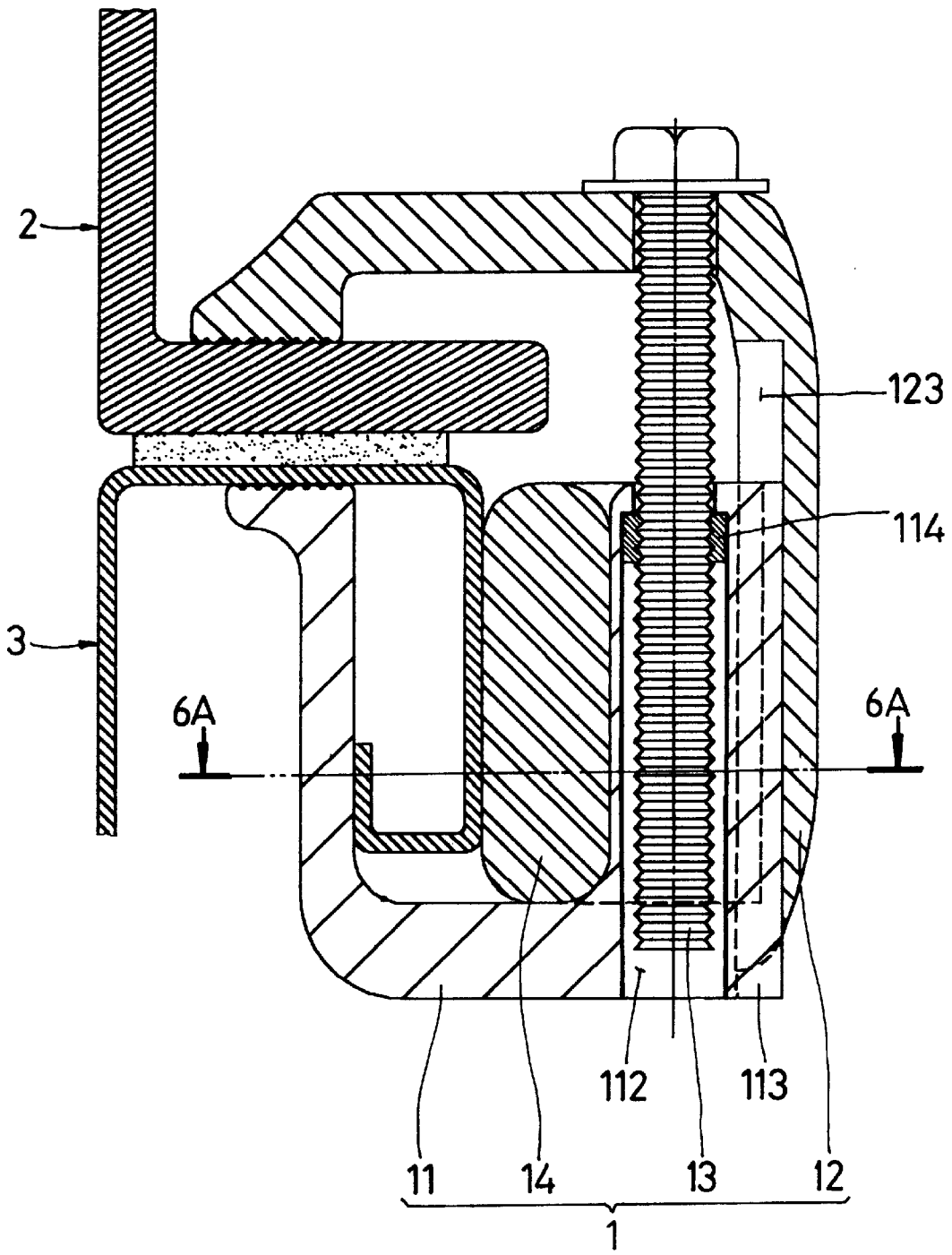
FIG. 5 is a schematic view illustrating a clamp device and a lining block of a preferred embodiment clamping a cap and a truck bed rail together.
Figure 6:
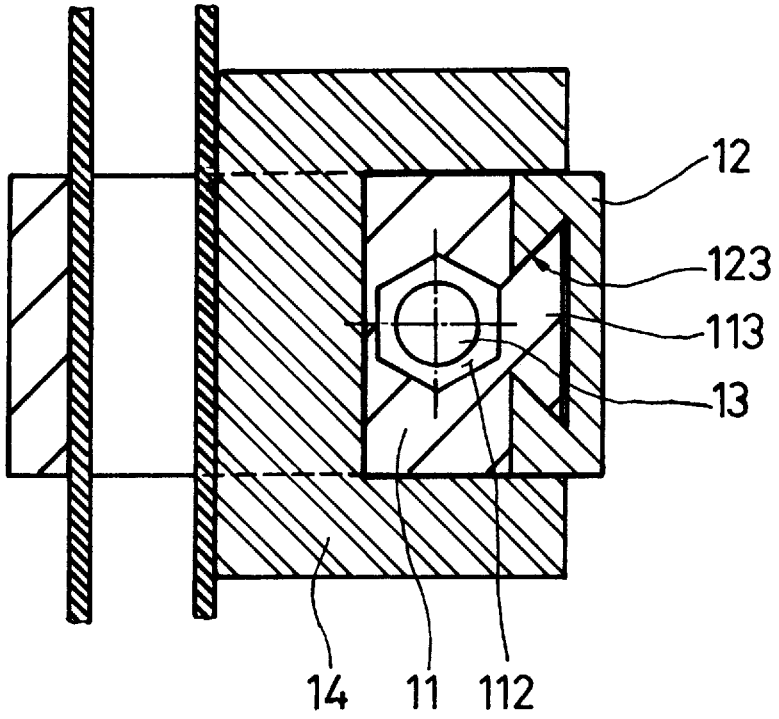
FIG. 6 is a sectional view taken along line 6A—6A of FIG. 5.

Referring to FIGS. 4 and 5, a lining block 14 is disposed in the spacing defined between the generally U-shaped body member 11 and the generally L-shaped body member 12.

Figure 7:
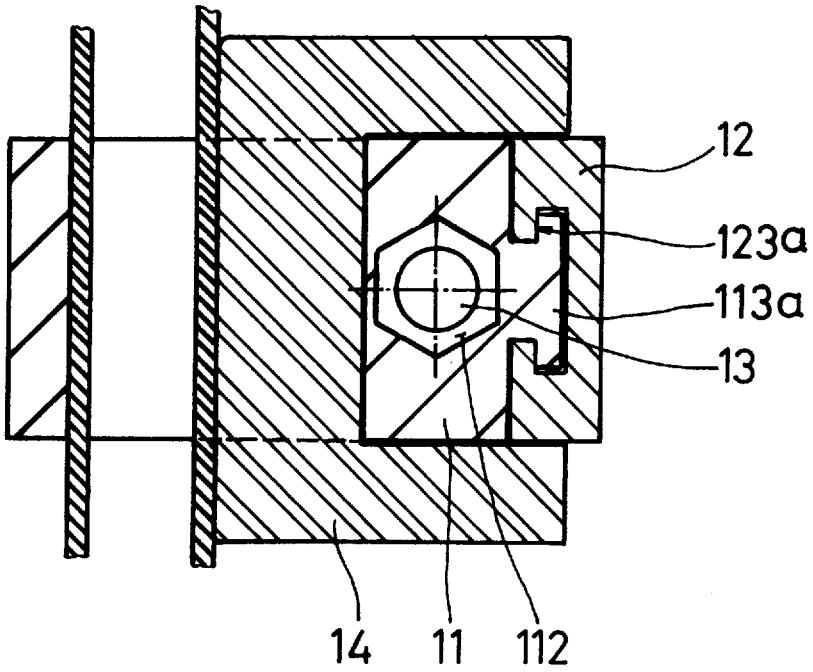
FIG. 7 is a sectional assembly view of a clamp device and a lining block of another preferred embodiment in accordance with the present invention.

Referring to FIG. 7, another clamp device comprises a generally U-shaped body member 11, and a generally L-shaped body member 12 engaging with the generally U-shaped body member 11. The generally L-shaped body member 12 comprises a guide groove 123*a*. The generally U-shaped body member 11 comprises an insertion block 113*a* inserted in the guide groove 123*a* of the generally L-shaped body member 12.

The invention is not limited to the above embodiment but various modification thereof may be made. Further, various changes in form and detail may be made without departing from the scope of the invention.

I claim:

1. A clamp device comprises:

a generally U-shaped body member and a generally L-shaped body member engaging with the generally U-shaped body member, the generally L-shaped body member having a longitudinal portion, a transverse portion, and an anti-skid pod located at a free end of the generally L-shaped body member, a through hole formed on the transverse portion of the generally L-shaped body member, a guide groove formed on the longitudinal portion of the generally L-shaped body member, the generally U-shaped body member having a first leg, a second leg, and an anti-slip pod located at a free end of the generally U-shaped body member, an insertion block disposed on the second leg, the insertion block inserted in the guide groove of the generally L-shaped body member, a hexagonal hole formed in the second leg, a round opening formed on an upper end of the second leg communicating with the hexagonal hole, the through hole of the generally L-shaped body member matching the hexagonal hole and the round opening of the second leg, a nut inserted in the hexagonal hole of the second leg, a washer disposed on the transverse portion of the generally L-shaped body member matching the through hole of the generally L-shaped body member, a bolt having a hexagonal head and a threaded shank, the bolt passing through the washer, the through hole of the generally L-shaped body member, the round opening of the second leg, and the nut, and the bolt inserted in the hexagonal hole of the second leg.

2. The clamp device as claimed in claim 1, wherein the inserting block is in a dovetail shape.

* * * * *